United States Patent [19]

Koh et al.

[11] Patent Number: 5,043,763

[45] Date of Patent: Aug. 27, 1991

[54] IMAGE FORMING APPARATUS HAVING A HEATER IN CONTACT WITH A FILM TO FIX A TONER IMAGE

[75] Inventors: Shokyo Koh, Yokohama; Yoshihiko Suzuki, Tokyo; Shigeo Kimura, Yokohama; Atsushi Hosoi, Kawasaki; Masahide Kinoshita, Yokohama; Kensaku Kusaka, Kawasaki; Hiroyuki Adachi, Tokyo, all of Japan

[73] Assignee: Canon Kabushiki Kaisha, Tokyo, Japan

[21] Appl. No.: 409,341

[22] Filed: Sep. 19, 1989

[30] Foreign Application Priority Data

Sep. 19, 1988 [JP] Japan ..... 63-234267
Dec. 16, 1988 [JP] Japan ..... 63-318096

[51] Int. Cl.[5] ..... G03G 21/00

[52] U.S. Cl. ..... 355/206; 355/285; 355/290

[58] Field of Search ..... 355/206, 282, 285, 289, 355/41, 284, 286, 290, 203, 242, 295; 219/216; 432/60

[56] References Cited

U.S. PATENT DOCUMENTS 3,809,475 5/1974 Post et al. ..... 355/206
3,811,828 5/1974 Ohta et al. ..... 432/227
3,924,945 12/1975 Weigl ..... 355/242 X
3,948,215 4/1976 Namiki ..... 118/60
3,999,851 12/1976 Sakamaki et al. ..... 355/206
4,059,394 12/1977 Ariyama et al. ..... 355/285 X
4,438,321 3/1984 Moraw ..... 355/289 X
4,521,095 6/1985 Mayer ..... 355/285
4,566,783 1/1986 Schwierz et al. ..... 355/289
4,823,163 4/1989 Rollet et al. ..... 355/41

FOREIGN PATENT DOCUMENTS

EP0295901 12/1988 European Pat. Off. .
63-56662 3/1988 Japan .

OTHER PUBLICATIONS

Communication Indicating Documents Considered to be Relevant Citing Foreign counterpart.

*Primary Examiner*—A. T. Grimley
*Assistant Examiner*—Sandra L. Hoffman
*Attorney, Agent, or Firm*—Fitzpatrick, Cella, Harper & Scinto

[57] ABSTRACT

An image fixing apparatus includes a heater which is fixed during an image fixing operation, a film for sliding movement of the heater, wherein a toner image on a recording material is heated by heat from the heater through the film, detecting means for detecting non-movement of the film, and power supply stopping means for stopping energization of the heater in response to an output of the detecting means.

15 Claims, 7 Drawing Sheets

IMAGE FORMING APPARATUS HAVING A HEATER IN CONTACT WITH A FILM TO FIX A TONER IMAGE

FIELD OF THE INVENTION AND RELATED ART

The present invention relates to an image fixing apparatus for heating, fusing and fixing a toner image on a recording medium, more particularly to an image fixing apparatus wherein the heat is applied to the toner through a film.

In a conventional image fixing apparatus wherein the toner image is fixed on the recording medium, the recording medium is passed through a nip formed between a heating roller maintained at a predetermined temperature and a pressing or back-up roller having an elastic layer and press-contacted to the heating roller, the recording medium supporting an unfixed toner image.

The conventional image fixing system of this type requires that the heating roller is always maintained at an optimum temperature, and requires that the recording medium is also heated, with the result that the thermal capacity of the heating roller is large. Therefore, the energy required for the image fixing is large, and in addition, unnecessary heat is to be produced with the result of temperature rise of the inside of the apparatus using the fixing apparatus.

In order to solve this problem, U.S. Ser. No. 206,767 proposes a novel image fixing apparatus wherein the toner image is fused using a small thermal capacity heater and an image fixing film slidable relative to the heater. In the apparatus of this type, however, because the thickness of the fixing film is small, the fixing film is liable to be damaged or fused if a certain portion of the fixing film is continuously subjected to the high temperature. In addition, in the case that the recording medium is closely contacted to the fixing film, the recording medium is also subjected to the high temperature with the possibility of smoking.

SUMMARY OF THE INVENTION

Accordingly, it is a principal object of the present invention to provide an image fixing apparatus wherein the film is not damaged or fused by heat.

It is another object of the present invention to provide an image fixing apparatus wherein the energization of the heater is stopped when the film is stopped.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
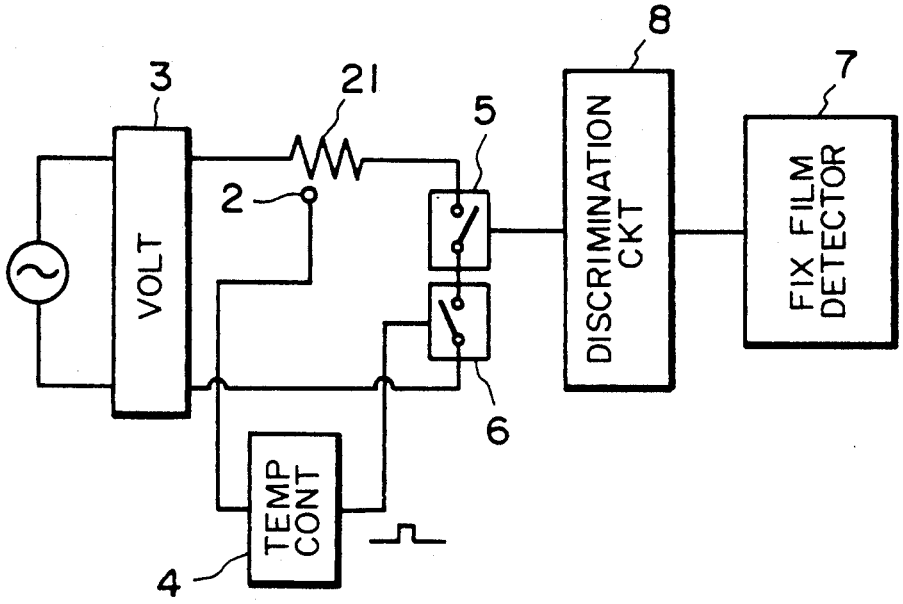
FIG. 1 is a block diagram illustrating an operation of an apparatus according to an embodiment of the present invention.

The preferred embodiments of the present invention will be described in detail in conjunction with the accompanying drawings wherein like reference numerals are assigned to the elements having the corresponding functions.

Figure 2:
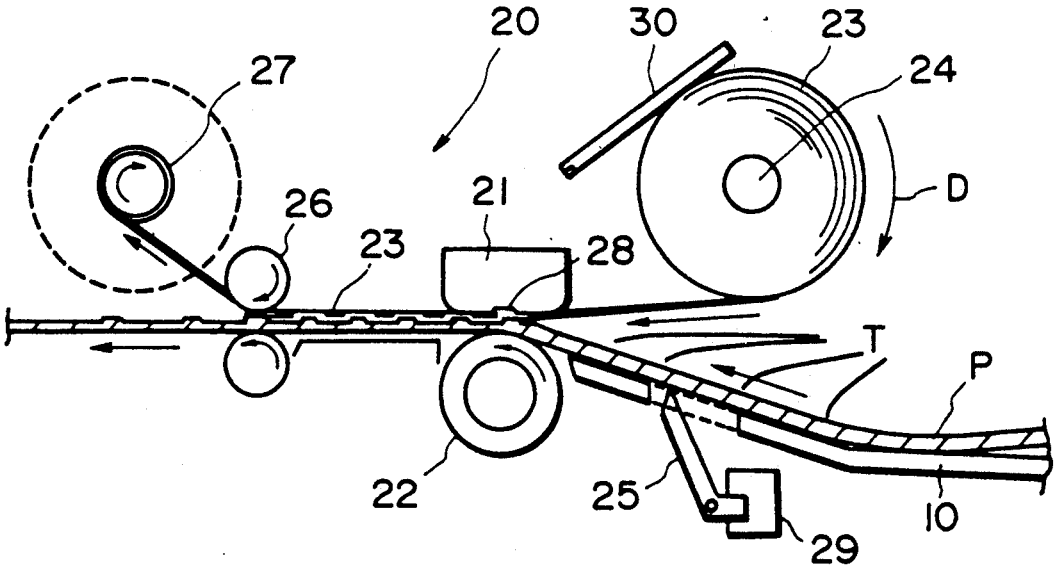
FIG. 2 is an enlarged side view of an image fixing apparatus according to an embodiment of the present invention.

Referring first to FIG. 2, there is shown an image fixing apparatus according to an embodiment of the present invention in a cross-section. The image fixing apparatus comprises a heat generating member 21 functioning as a heating member. The heat generating member 21 includes a base member made of electrically insulating and heat-resistive material such as alumina or the like or a compound material containing it, a heat generating layer in the form of a line or a stripe made of $Ta_2N$ or the like and a surface protection layer resistive against sliding movement, made of $Ta_2O_5$ or the like.

The bottom surface of the heat generating member 21 is smooth, and the front and rear portions are rounded to permit smooth sliding of a fixing film 23. The fixing film 23 is made, for example, of PET treated for heat-resistance having a thickness of approximately 6 microns. It is wound on a film feeding shaft 24. The film is fed out in the direction indicated by an arrow D. The fixing film 23 is contacted to the surface of the heat generating member 21 and is taken up on a film take-up shaft 27 by way of a separating and conveying roller 26 having a large curvature.

The heat generating layer 28 of the heat generating member 21 has a small thermal capacity, and is pulse-wisely energized, and it is instantaneously heated up to approximately 300° C. each time. The leading and trailing edges of the recording sheet P on which the unfixed toner image is formed are detected by a recording sheet detecting lever 25 and a recording sheet detecting sensor 29. In response to the detections, the heat generating layer 28 is energized upon necessity. The energization of the heat generating member 21 may be controlled in accordance with position detection of the recording sheet P using a sheet feed sensor of an image forming apparatus with which the image fixing apparatus is used.

On the other hand, the back-up roller 22 includes a core made of metal or the like and an elastic layer made of silicone rubber or the like. It is driven by an unshown driving source and is pressed to the heat generating member 21 through the fixing film 23 moving at the same speed as the recording sheet P advanced by a conveyance guide 10 and having the unfixed toner image T. The conveyance speed by the pressing roller 22 is preferably substantially the same as the conveyance speed of the sheet during the unfixed toner image formation on the recording sheet. The fixing film 23 speed is determined following this speed. Designated by a reference 30 is a sensor for sensing the fixing film 23.

In this embodiment, the temperature of the heat generating layer 28 is instantaneously raised, and therefore, preliminary heating is not required, and the heat transfer to the back-up roller 22 during the non-image-fixing operation is small. During the fixing operation, the fixing film 23 and the toner image T and the recording sheet P are interposed between the heat generating layer 28 and the pressing roller 22, and in addition, the heat generating period is short with the result of steep temperature gradient, by which the back-up roller 22 is not easily raised in temperature. The temperature is maintained lower than the fusing point of the toner even when the image forming operation is continuously performed in a practical manner.

In the apparatus of this embodiment, the toner image T made of heat-fusible toner on the recording sheet P is first heated and fused by the heat generating member 21 through the fixing film, and particularly, the surface portion thereof is heated up to highly above the fusing point, by which the toner is completely softened and fused. At this time, the back-up roller 23 establishes close contact between the heat generating member 21, the fixing film 23, the toner image T and the recording sheet P, so that the heat transfer is efficient.

Thereafter, the heat generation of the heat generating member 21 stops, and the recording sheet P is continued to advance and is separated from the heat generating member 21, by which the heat of the toner image T is irradiated so that the toner image T is cooled and solidified. Then, the fixing film 23 is separated from the recording sheet P by the separating and conveying roller 26 having a large curvature. At this time, in this embodiment, the temperature of the back-up roller 22 is maintained lower than the fusing point of the toner, and therefore, the heat radiation of the toner image T is promoted.

This reduces the time required for the cooling, so that the size of the apparatus can be reduced. As described in the foregoing, the toner image T is once completely softened and fused, and then is solidified, the coagulation force of the toner is very strong, and therefore, the toner behaves as a mass. In addition, since the toner is pressed by the back-up or pressing roller 22 when it is softened and fused by heat, at least a part of the toner image T soaks into the surface layer of the recording sheet P, and then cooled and solidified. This permits the toner image T to be fixed on the recording sheet P without off-set to the fixing film 23.

Here, the state of the toner referred to in this Specification will be described. The toner fusing point used here means the minimum temperature required for fixing the toner and covers the case where the viscosity thereof decreases to such an extent as can be said to be fused, at the minimum fixable temperature and the case where the viscosity decreases to such an extent as can be said to be softened, at the minimum fixable temperature. Therefore, even when it is said that the toner is fused for convenience, it actually may mean the viscosity decrease to such an extent that it is actually softened. Similarly, when it is said that the toner is cooled and solidified for convenience, it actually may not be solidified depending on the materials of the toner. but can be said that the viscosity is sufficiently increased.

Referring to FIG. 1, there is shown a block diagram further illustrating this embodiment.

Figure 5:
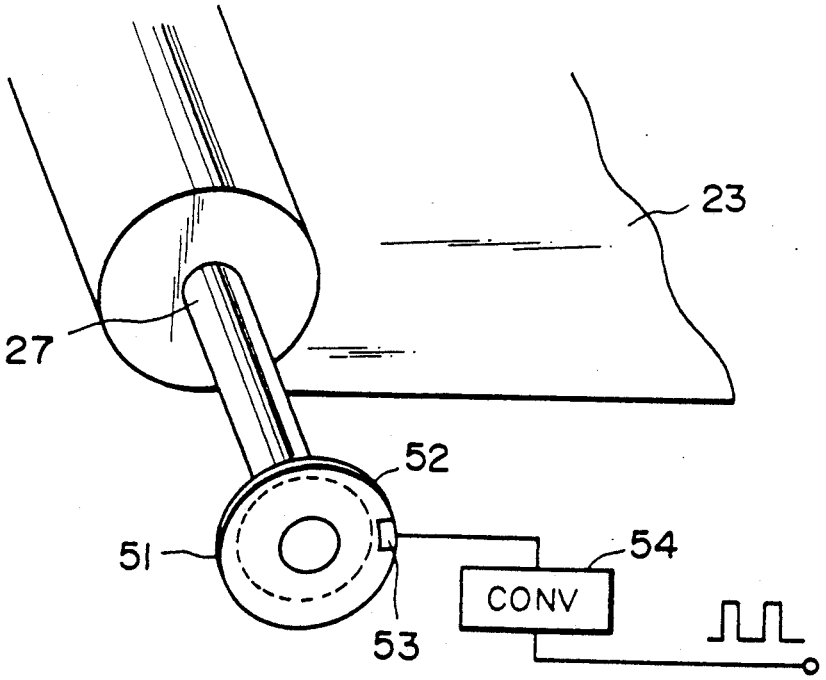
FIG. 5 is an enlarged perspective view of a means for detecting stoppage of the fixing film.

The system of FIG. 1 comprises the heat generating member 21, a temperature sensor 2 and a power source 3 for supplying electric power to the heat generating member 1, a temperature controlling circuit 4 for controlling the temperature of the heat generating member 1 by operating a second switch 6. A first switch 5 is normally closed. An image fixing film stoppage discriminating circuit 8 receives a signal from an image fixing film stoppage detecting means 7 to discriminate stoppage of the fixing film 23. Upon the discrimination, the stoppage discriminating circuit 8 instructs the first switch 5 to open, thus stopping the power supply to the heat generating member FIG. 5 shows the film stoppage detecting means. As described in conjunction with FIG. 2, the fixing film 23 is taken up on the take-up shaft 27. Using this, as shown in FIG. 5, the rotation of the film take-up shaft 27 is detected by the film stoppage detecting means.

In FIG. 5, a disk 51 is mounted on the take-up shaft 27 rotatable together with movement of the film and is provided with light-transmitting slits. A light emitting element 52 and a light receiving element 53 are disposed with the disk 51 therebetween. The light receiving signal by the light receiving element 53 is converged to an electric signal by an electric signal converting circuit 54. With this structure, pulse signals are produced when the fixing film 23 is moving.

Figure 3:
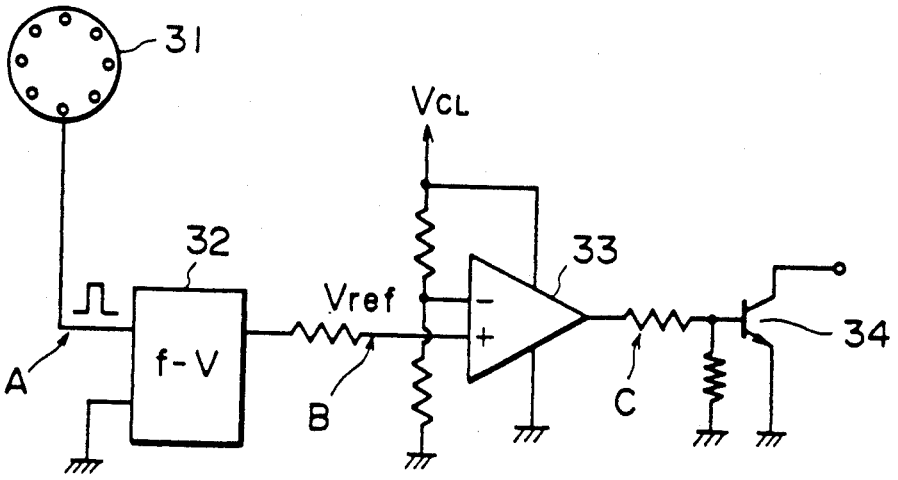
FIG. 3 shows a circuit for discriminating stoppage of the fixing film.
Figure 4:
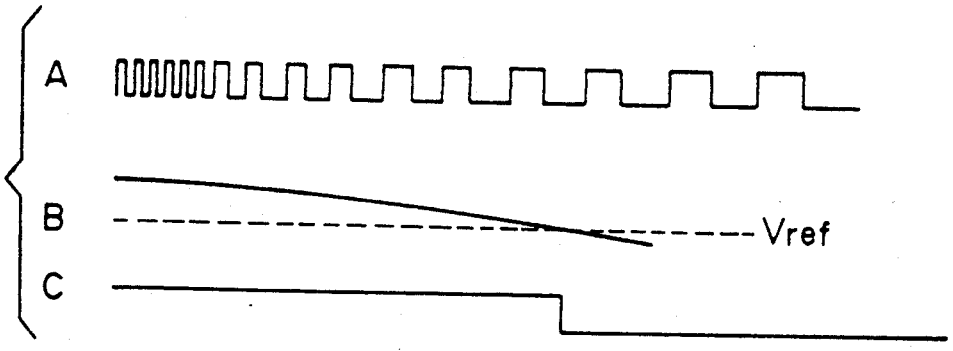
FIG. 4 illustrates operation signals.

FIG. 3 shows the film stoppage discriminating circuit, wherein the pulse output of the film stoppage detecting means 31 is supplied to f-V converter 32 to produce a voltage output. A voltage comparator 33 compares the output voltage of the f-V converter 32 and a reference voltage Vref. In accordance with the result of comparison, the first switch 5 of FIG. 1 is operated. A transistor 34 functions to operate the switch 5. When the fixing film is moved, the fixing film stoppage detecting means 31 produces pulses at intervals. As this time, the output voltage of the f-V converter 32 is higher than the reference voltage Vref, so that the transistor 34 is rendered on to close the first switch 5 which may be in the form of a relaying circuit or a contactless switching circuit such as FET.

When the moving speed of the fixing film decreases, the output frequency of the fixing film stoppage detecting means 31 also decreases with the result of reduced output voltage of the f-V converter 32. When the output voltage becomes lower than the reference voltage Vref, that is, the film moving speed becomes lower than a predetermined speed, the transistor 34 is rendered off to open the first switch 5 and open the power supply circuit, thus shuting off the power supply thereto. Of course, the transistor 34 is rendered off when the fixing film is stopped, and therefore, the first switch 5 is opened, and the power supply circuit is opened.

In this manner, when the film moving speed decreases down to a predetermined, more particularly, when the fixing film stops, the power supply to the heat generating member is stopped, by which the fixing film is locally heated, so that the fixing film is protected from the thermal damage. In addition, when the recording material such as the recording sheet is contacted to the fixing film, the recording material is prevented from over heating.

Figure 6:
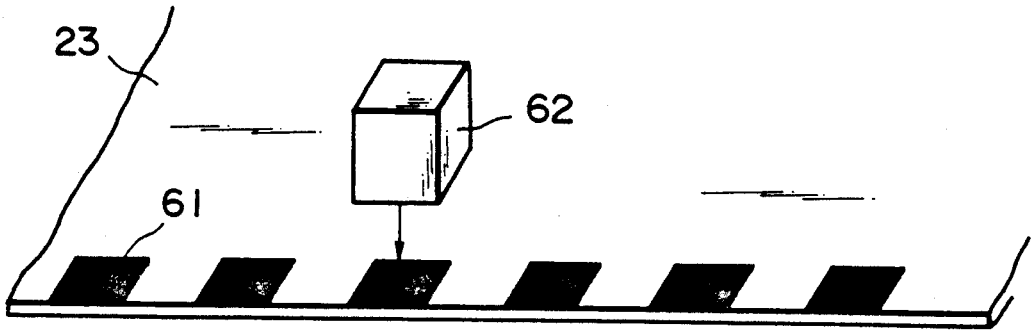
FIG. 6 is an enlarged perspective view of the apparatus according to a second embodiment of the present invention.

Referring to FIG. 6, there is shown a part of an apparatus according to a second embodiment of the present invention. In this embodiment, the fixing film 23 is provided with a mark 61 at an end thereof. The mark 62 is read by a film end reading means 61, by which the film stoppage is detected. By such a simple structure, the film stoppage can be detected with certain detection.

As regards the stoppage of the power supply for stopping the power supply to the heat generating member in accordance with the film stoppage detecting means is the same as in the first embodiment.

Figure 7:
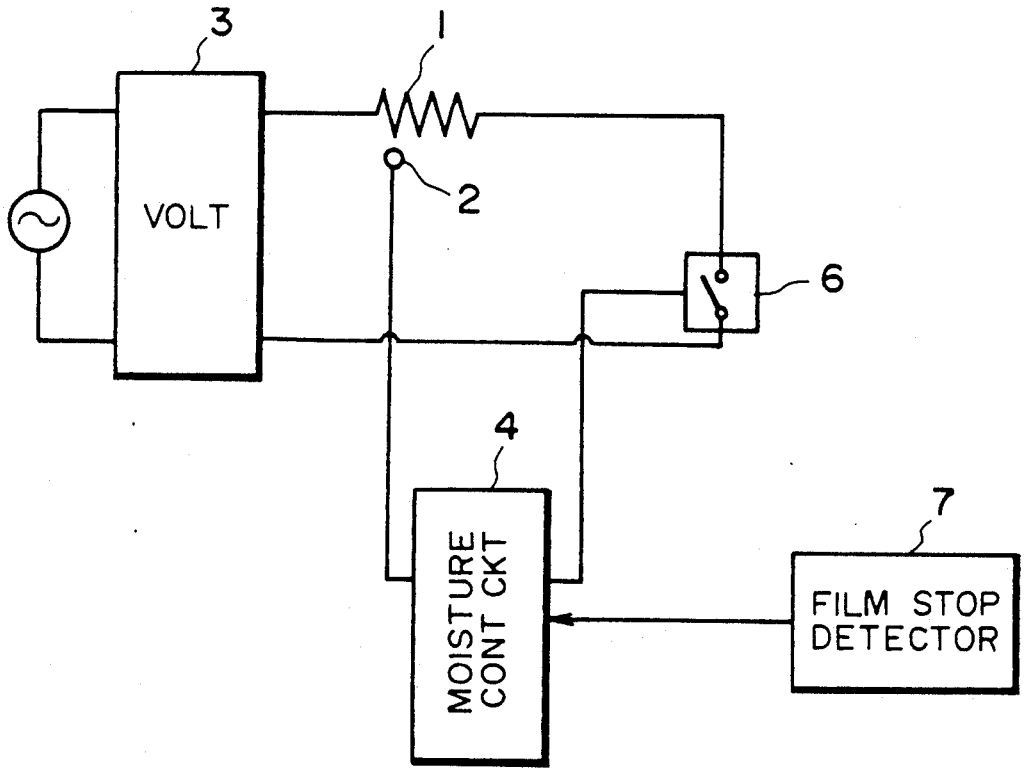
FIG. 7 illustrates a third embodiment of the present invention.

FIG. 7 shows a system according to a third embodiment of the present invention in this embodiment, as constructed to the first and second embodiment, the output signal of the fixing film stoppage detecting means 7 or the fixing film stoppage discriminating circuit is supplied to a temperature controlling circuit 4 to stop an output signal of the temperature controlling circuit 4, by which the power supply to the heat generating member 21 is stopped. This eliminates necessity of an independent power supply stopping means.

According to these embodiments, the power supply to the heater element can be stopped when the film is stopped, or the film moving speed decreases down to a predetermined speed due to a jammed recording material or the like. Therefore, the film is prevented from being locally heated to an extremely high temperature. Thus, the damage or fusing of the film can be prevented, and in addition, the smoking of the recording material is prevented.

Figure 8:
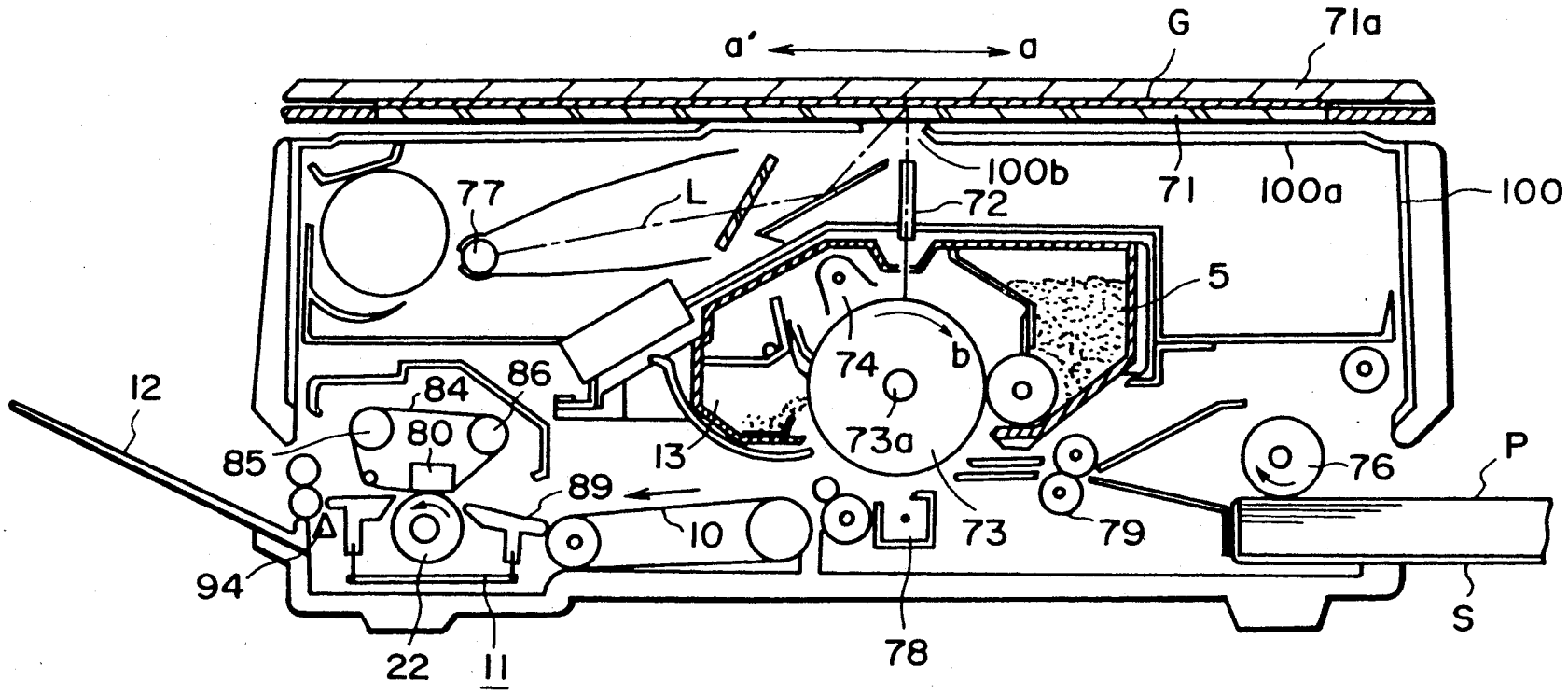
FIG. 8 is a front sectional view illustrating an image forming apparatus using the image fixing apparatus according to an embodiment of the present invention.

Referring to FIG. 8, there is shown an electrostatic copying machine using an image fixing apparatus according to a further embodiment of the present invention. The copying apparatus comprises a housing 100, a reciprocable original supporting platen 71 made of transparent material such as glass disposed in a top plate 100*a* of the housing, the original supporting platen is movable above the top plate 100*a* in the right and left directions a and a'.

An original G is placed face-down on the original supporting platen 71 at a predetermined index on the top surface thereof, and the original G is covered by an original cover 1*a*.

A slit opening 100*b* is formed in the top plate 100*a*, extending perpendicular to the reciprocal movement direction of the original supporting plate 71 (perpendicular to the sheet of drawing). The bottom surface, that is, the image carrying surface of the original G placed face-down on the original supporting platen 71 is moved in the direction a, by which each part of the original is passed by the slit opening 100*b*. During the passage, the original is illuminated by light L from a lamp 77 through the slit opening 100*b* and the transparent original supporting platen 71, so that the original is optically scanned. The light reflected by the original is imaged on a surface of a photosensitive drum 73 by an array 72 of short focus and small diameter imaging elements.

The photosensitive drum 73 has a photosensitive layer such as zinc oxide photosensitive member or an organic photosensitive layer and is rotated in a direction indicated by an arrow b at a predetermined speed about a central shaft 73*a*. During the rotation, it is uniformly charged to a positive or negative polarity by a charger 74 and is exposed to the imaged light through the slit, so that an electrostatic latent image is sequentially formed corresponding to the image of the original.

The electrostatic latent image is developed into a visualized image with toner made of resin which is softened or fused by heat in a developing device 5. The toner image is advanced into an image transfer station containing an image transfer discharger 78.

The recording material in the form of a transfer sheet of paper P in this embodiment is contained in a cassette S. The transfer sheet is drawn out of the cassette by rotation of a pick-up roller 76. The sheet is then advanced by a registration roller 79 at such timing that when a leading edge of the toner image formed area on the drum 73 reaches the position of the transfer discharger 78, the leading edge of the transfer sheet P reaches a position between the transfer discharger 78 and the photosensitive drum 73, by which they are aligned. The toner image on the photosensitive drum 73 is transferred sequentially to the surface of the fed sheet by the transfer discharger 78. The sheet now having the toner image transferred thereon at the transfer station is sequentially separated from the surface of the photosensitive drum 73 by an unshown separating means and is advanced into an image fixing device 11 where the unfixed toner image is heated and fixed. The sheet is then, discharged onto a discharge tray 12 outside the image forming apparatus as a print or copy.

The surface of the photosensitive drum 3 after the toner image transfer is cleaned by the cleaning device 13, by which the contaminations such as the residual toner or the like is removed to be prepared for the next image forming operation.

Figure 9:
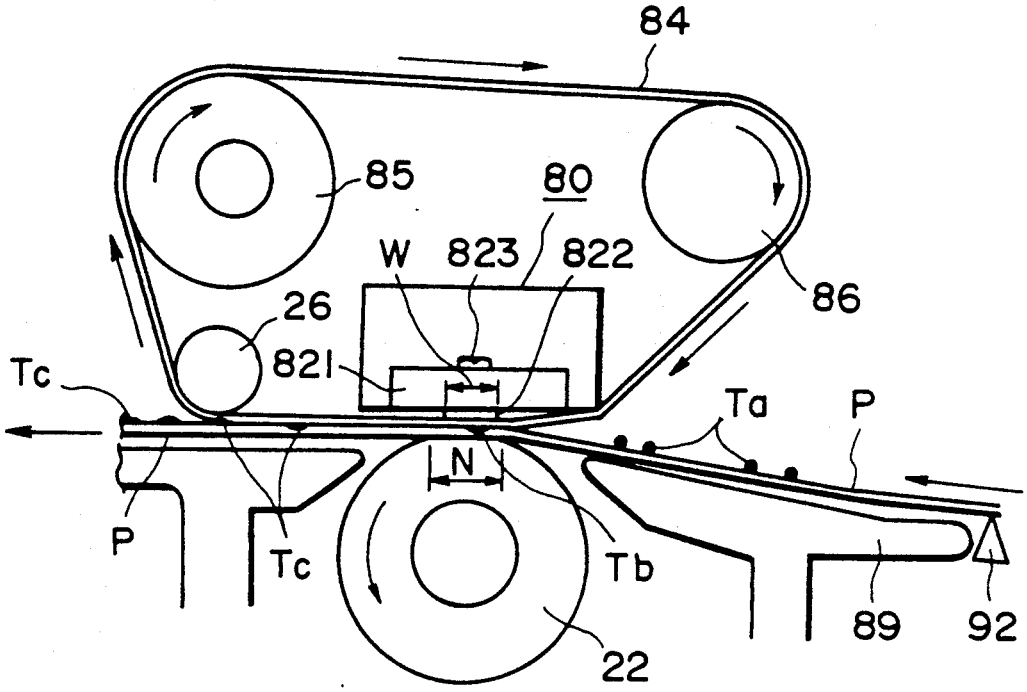
FIG. 9 is an enlarged view of the image fixing apparatus used in the image forming apparatus of FIG. 8.

Referring to FIG. 9, the image fixing apparatus used in this embodiment will be described. The image fixing apparatus comprises a image fixing film 84 in the form of an endless belt, a left side driving roller 85, a right side follower roller 86, a separating roller 26 disposed below the driving roller 85 and a low thermal capacity heater 80 disposed below a position between the driving roller 85 and the follower roller 86. The endless fixing film 84 is stretched around these rollers and the heater 80.

The follower roller 86 functions also as a tension roller for applying tension to the endless fixing film 84. When the driving roller 85 rotates in the clockwise direction, the fixing film 84 travels at a predetermined peripheral speed without production of a crease or wrinkles, without snaking movement and without slip. The predetermined speed is substantially the conveying speed of the transfer sheet P conveyed from the image forming station 8 of the image forming apparatus and carrying on its top surface the unfixed toner image Ta.

The fixing apparatus further comprises a pressing or back-up member or roller 22 having a rubber elastic layer made of silicone rubber having a good parting property. The back-up roller 22 is pressed to the bottom surface of the heating member 20 under a total pressure of 4–7 kg by an unshown urging means through the endless fixing film 24 at its bottom side travel. The back-up roller 22 rotates in the counterclockwise direction to peripherally move codirectionally with the conveyance of the transfer sheet P.

Since the endless fixing film 84 rotates along an endless path to be repeatedly used for heating and fixing the toner images, it exhibits good heat-resistance, releasing or parting property and durability. The thickness thereof is not more than 100 microns, further preferably not more than 50 microns. It may be a single layer film of a heat resistive resin such as polyimide, polyetherimide or PFA resin (copolymer of tetrafluoroethyleneperfluoroalkyd vinylether, or it may be a multi-layer film including a thicker film of 20 microns coated with a parting layer of 10 microns at least on the side contactable to the image, the coating being made of PTFE resin (tetrafluoroethylene resin) added by electrically conductive material.

The heater has a low thermal capacity and is in the form of a line or stripe. It, for example, comprises an alumina base plate 821 having a thickness of 1.0 mm, a width of 10 mm and a length of 240 mm and electric resistance material such as $Ta_2N$ extending along a length of the base plate 821 substantially at the middle of the width thereof on its bottom surface. The electric resistance material is applied thereon with the width of 1.0 mm in the form of a line or a stripe to constitute the heat generating member 22. In this embodiment, the linear or stripe heat generating member 822 is energized by wiring at its longitudinal opposite ends to produce the heat over the entire length of the heat generating member 822. The power supply is in the form of a pulse wave of DC 100 V and the period of 20 msec. The power supply controlling circuit controls the pulse width in accordance with the temperature detected by the temperature detecting thermister 823 press-contacted to the back side of the base plate, the target temperature and the energy radiation. The pulse width is controlled within the range between 0.5–5 msec. The heat generating member 822 is instantaneously heated up to a temperature between 200°–300° C. each time the pulse is produced.

Figure 12:
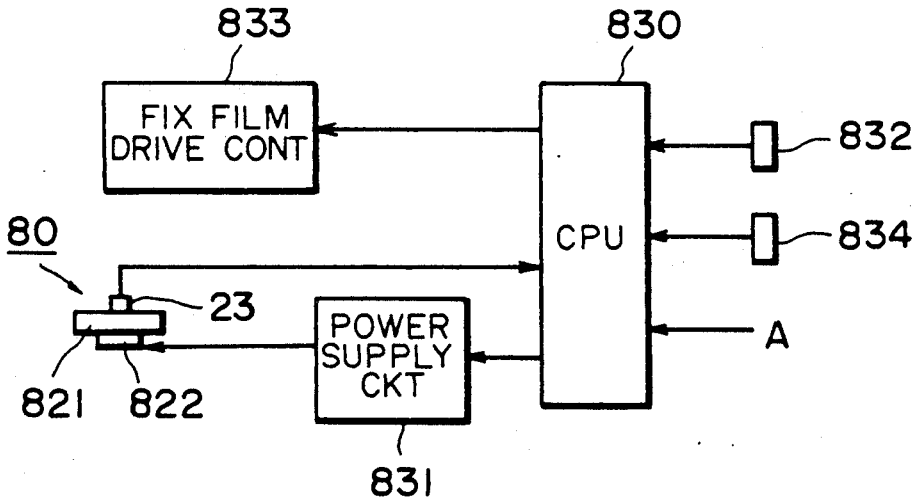
FIG. 12 is a block diagram for a control system.

In this embodiment, the temperature of the heater constituted by the base plate 821 and the heat generating member 822 is detected by the thermister 823, and the detected temperature is transmitted to a control circuit 830 (FIG. 12). In response to the processing by the control circuit, the power supply circuit 831 for supplying power to the heat generating member 822 is controlled, by which the temperature of the heater is controlled at 200° C.

Figure 10:
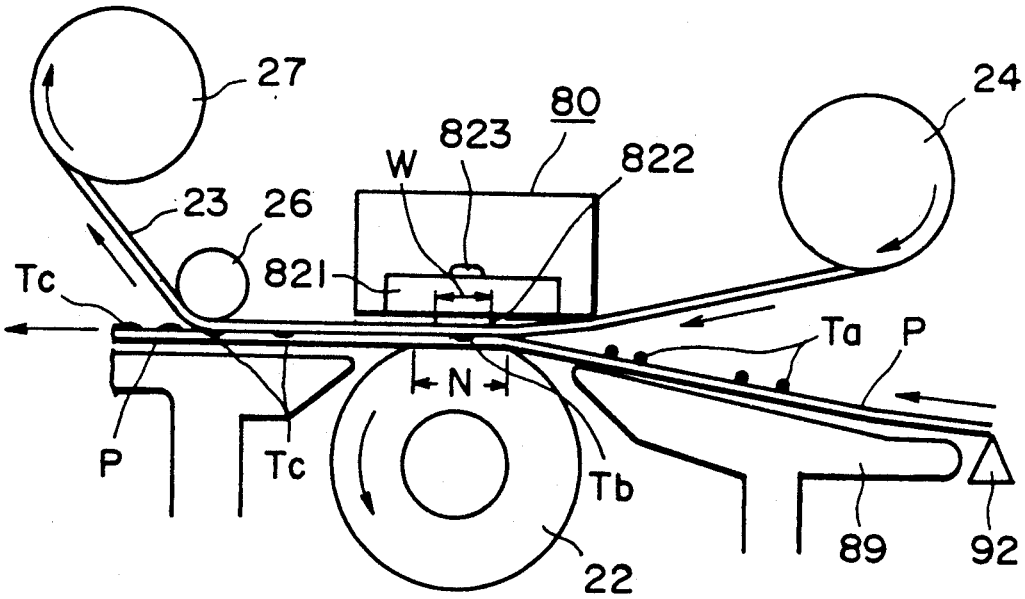
FIG. 10 shows another example of the fixing apparatus.
Figure 11:
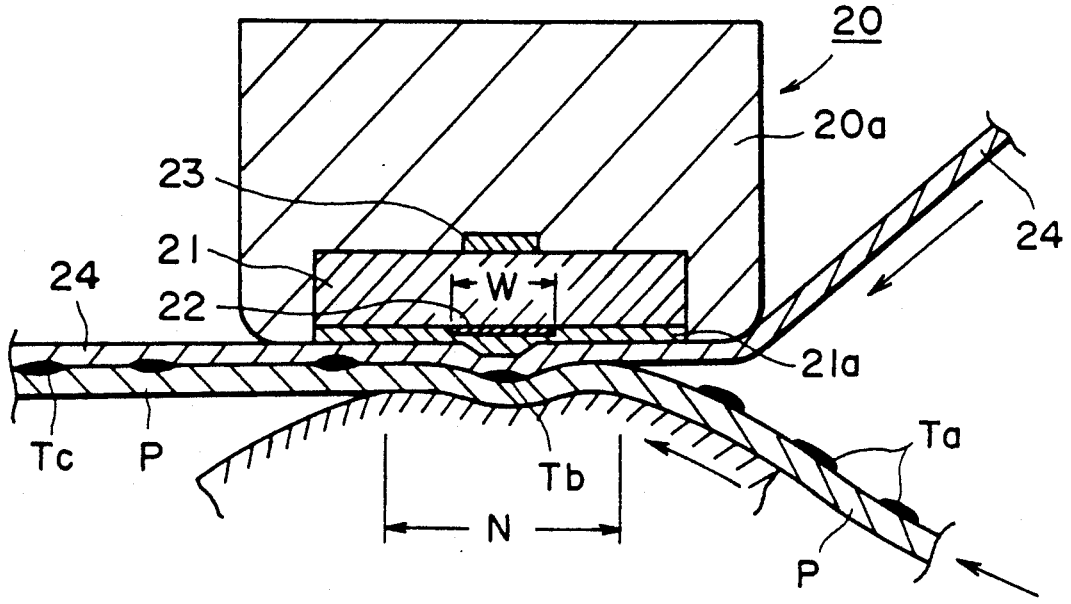
FIG. 11 is a cross-sectional view of a heater.

The fixing film 84 is not limited to the form of the endless belt. It may be, as shown in FIGS. 2 and 10, in the form of a film rolled on a feeding shaft 24 and a take-up shaft 27 and stretched therebetween and between the heater 80 and the back-up roller 22 below the separating roller 26. The fixing film 23 in this case is advanced from the feeding shaft 24 to the take-up shaft 27 at the same speed as the speed of the transfer sheet P.

In response to an image formation starting signal, the image forming apparatus operates to produce and introduce to the fixing device 11 from the transfer station 78 a transfer sheet P carrying on its top surface the unfixed toner image Ta. When the leading edge of the transfer sheet P is detected by a sheet sensor 92 (FIGS. 9 and 10) disposed adjacent to the fixing apparatus, the movement (rotation) of the fixing film 84 is started by the drive control circuit 33. The power supply to the heat generating member 822 is started at the point of time $t_2$ which is 0.5 sec, in this embodiment, after a delay period (timer period) from the point of time $t_1$ (FIG. 13) at which the film travel starts. By this, the heater is energized and is temperature-controlled.

The transfer sheet P is guided along a guide 89 and is introduced between the fixing film 84 and the pressing roller 22 in the nip N formed between the heating member 80 and the back-up roller 22. The transfer sheet P is moved while its surface carrying the unfixed toner image is being in press-contact with the bottom surface of the fixing film 84 which is moving in the same direction as and at the same speed as the transfer sheet P. It is moved together with the fixing film 84 through the nip N between the heater 80 and the pressing roller 22 without slip or without production of the crease. During the passage through the nip N, the toner image is heated and softened or fused. In this embodiment, the heater 80 has a linear heat generating element 822 and a heating member 821 integral with the low thermal capacity heat generating element 822 which is pulsewisely energized to produce pulsewise heat. In other words, the toner image Ta on the sheet P conveyed at the predetermined conveying speed is introduced together with the fixing film 84 into an effective heating width W determined in accordance with the linear heat generating element 822 of the heater 80, by which it is heated and softened or fused into a fused image Tb.

The portion of the sheet having passed through the nip N is maintained closely contacted to the fixing film stretched and moved between the heater 80 and the separating roller 26 until it reaches the separating roller 26. This conveying step is used as a cooling step wherein the heat of the softened or fused toner Tb is irradiated, by which the toner is cooled and solidified into a solidified toner image Tc.

When it reaches the separating roller 26, the fixing film 84 is deflected away from the surface of the sheet P along the surface of the separating roller 26 having a large curvature, by which the fixing film 84 and the sheet P are separated, and the sheet P is discharged onto the discharging tray 12. By the time of this separation, the toner is sufficiently cooled and solidified so that the toner is adhered or fixed on the sheet with sufficient force, whereas the contacting force thereof to the fixing film 84 is extremely small, and therefore, the fixing film 84 and the sheet P are separated practically without toner offset to the fixing film 84.

At the point of time $t_3$ when the sheet trailing edge passage detecting sensor 94 (FIG. 8) detects the sheet P after being subjected to the image fixing operation, the power supply to the heat generating element 822 of the heater 80 is stopped. After a predetermined timer period $t_4$ (0.5 sec in this embodiment) from the point of time $t_3$, the fixing film 24 is stopped.

In this embodiment, the linear sheet generating element 822 of the heater 80 is instantaneously heated by the power supply up to a sufficiently high temperature in consideration of the toner fusing point or the fixable temperature, and therefore, the preliminary heating of the heater is not required. The heat transfer to the back-up roller 22 is small when the fixing operation is not performed. During the fixing operation, the fixing film, the toner image and the sheet are present between the heater 80 and the back-up roller 22, and a steep temperature gradient is produced due to the short heating period, and therefore, the back-up roller 22 is not heated much, so that the temperature thereof is maintained lower than the toner fusing temperature even if the image forming operation is continuously performed in a practical manner.

In this embodiment, the toner image of the heat-fusible toner on the sheet P is first heated and fused by the heater 80 through the fixing film 84, by which particularly, the surface portion thereof is completely softened or fused. At this time, the heater, the fixing film, the toner image and the sheet are sufficiently closely contacted by the back-up roller 22, and therefore, the heat transfer therebetween is efficient. By this, the toner image itself can be efficiently heated and fused with minimum heating of the sheet P itself. Particularly by limiting the power supply and heating period, the energy consumption can be reduced.

The size of the heater may be small, so that the thermal capacity thereof is small with the result of unnecessity of the preliminary heating of the heater, by which the power consumption when the image forming operation is not performed can be reduced, and in addition, the temperature rise in the apparatus can be prevented.

Since, in this embodiment, the temperature of the back-up roller 22 is maintained at a temperature lower than the fusing point of the toner, as described in the foregoing, it is possible that the heat radiation of the toner image during the subsequent cooling step can be promoted. This permits shorter cooling period, so that the size of the apparatus can be reduced.

Figure 13:
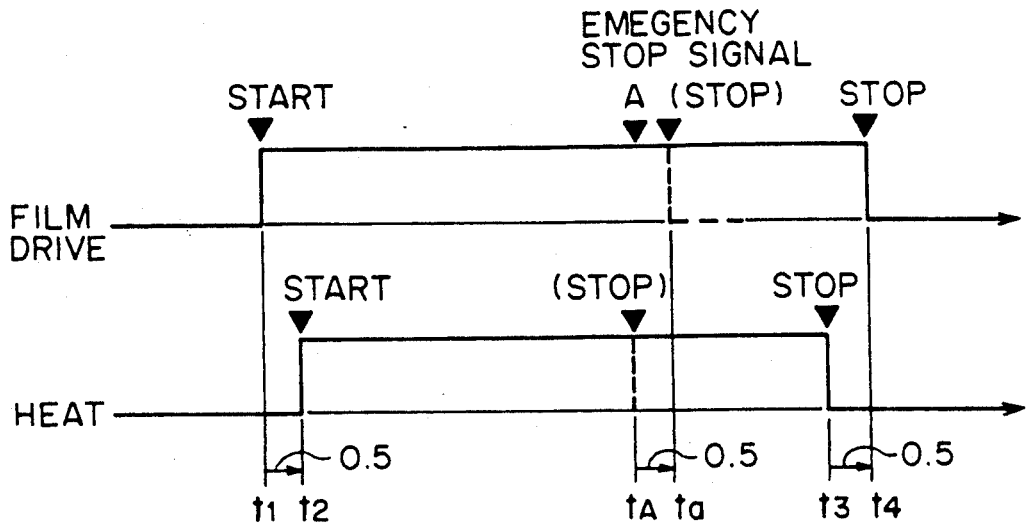
FIG. 13 is a timing chart illustrating an operation.

In the sequential operation shown in FIG. 13, the image fixing operation is started with the driving (rotation or traveling) of the fixing film 84, and then, the heater 80 is energized to fix the image. During the fixing completion step, the energy supply to the heater is first stopped, and then, the movement of the fixing film is stopped. Therefore, during the heat generation, the fixing film is assured to be moved. By this, the fixing film is prevented from locally over heated, by which the film is protected from thermal damage. This improves the durability of the fixing film.

In the case where the image forming apparatus is assured to be operated correctly without significant error, the drive of the fixing film and the energization of the heating element may be started and stopped simultaneously.

As shown by broken lines in FIG. 13, when the apparatus is stopped because of a problem such as improper sheet conveyance or the like, an emergency signal is produced, in response to which the energization of the heating element is first stopped at the time $t_A$, and only then (after a predetermined delay period $t_a$ (0.5)), the drive of the fixing film is stopped.

It is an effective alternative that the drive stop $t_4$ ($t_a$) of the fixing film after the stoppage of the power supply to the heater at the point of time $t_3$ (A) is effected, provided that the temperature detecting thermister 23 detects that the temperature of the heater is sufficient decreased, for example, down to less than 100° C. by the stoppage of the energy supply to the heat generating element.

It is possible that when the fixing operation is continued for a long period of time, the heat is accumulated in the heater so that the temperature of the heater does not instantaneously decrease even if the power supply is shut off. A thermal damage possibly occurs to the fixing film if the fixing film is stopped while being press-contacted to the heater which is not sufficiently decreased in temperature. However, the above-described structure is efficient to prevent the thermal damage even in that case.

Where the fixing film 24 is not endless, as shown in FIGS. 2 and 10, a replaceable rolled film can be employed, wherein when almost all of the fixing film is taken up on the take-up real, a new roll of film is mounted.

In this roll-replaceable type, the thickness of the fixing film can be reduced substantially irrespective of the durability of the fixing film, so that the power consumption can be reduced. For example, the fixing film in this case may be made of a less expensive material such as PET (polyester) film which is treated for heat-durability having a thickness of 12.5 microns or lower, for example.

Alternatively, since the toner offset to the fixing film surface is not practically produced, the used fixing film taken up on the take-up shaft can be rewound on the feeding shaft, or the take-up shaft and the feeding shaft are interchanged to use the fixing film repeatedly, if the thermal deformation or thermal deterioration of the fixing film is not significant (rewinding and repeatedly using type).

In this type, the fixing film is preferably made of a material exhibiting high heat-resistivity and mechanical strength, such as polyimide resin film having a thickness of 25 microns which is coated with a parting layer made of fluorine resin or the like having good parting property to constitute a multi-layer film. A press-contact releasing mechanism is preferably provided to automatically release the press-contact between the heater and the pressing roller during the rewinding operation.

Where the fixing film is used repeatedly as in the rewinding type and an endless belt type, a felt pad may be provided to clean the film surface and to apply a slight amount of parting agent such as silicone oil by impregnating the pad with the oil, by which the surface of the film is maintained clean and maintained in good parting property. Where the fixing film is treated with insulating fluorine resin, electric charge is easily produced on the film, the electric charge disturbing the toner image. In that case, the fixing film may be rubbed with a discharging brush which is electrically grounded to discharge the film. On the contrary, the film may be electrically charged by applying a bias voltage to such a brush without grounding as long as the toner image is not disturbed. It is a possible measure against the image disturbance due to the electric charge to add carbon black or the like in the fixing film. The same means is applicable against the electric charge of the back-up roller. As a further alternative, anti-electrification agent may be applied o added.

The structure of the heater 80 and the energization control of the heat generating element 822 are not limited to those described in the foregoing. For example, the heating member 80 may be in the form of a heating roller, and the heat generating element 822 may be a thick film resistor or a ceramic chip array having PTC characteristics. Furthermore, the energization control is not limited to the pulsewise energization, but it may be in the form of an ordinary AC energization.

As for the cooling and solidification of the toner may be based on the spontaneous heat irradiation, or may utilize a fan or a heat radiating fins or in another forced cooling type.

Figure 14:
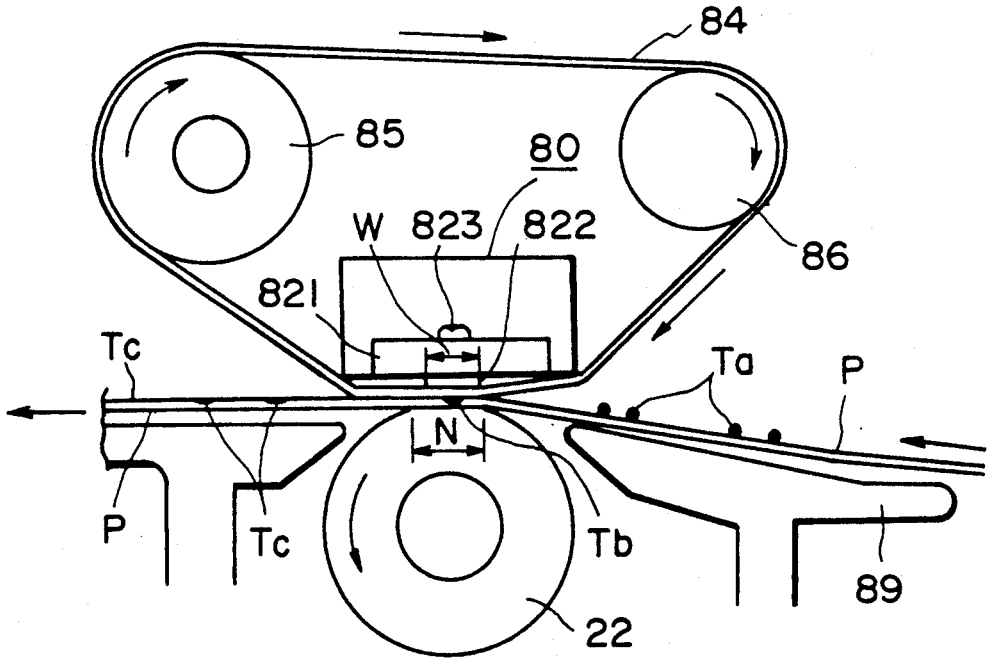
FIG. 14 is a sectional view of an image fixing apparatus according to a further embodiment of the present invention.

If the toner is such a type that it is sufficiently fused at a high temperature, the recording material (transfer material sheet) P is separated from the fixing film 94 immediately after the toner is heated to a sufficiently high temperature and fused in the heating step (in the fixing nip), as shown in FIG. 14.

In the foregoing description, an image transfer type electrophotographic copying apparatus is taken, but the means and process for the image formation is not limited to this type. It may be of a type wherein a toner image is directly formed and carried on an electrofax sheet or an electrostatic recording sheet or the like, wherein the image is formed and recorded magnetically, or wherein an image is formed with a heat-fusible toner on a recording medium by another image forming process and means. An examples of such apparatus are heat-fixing type copying machine, laser beam printer, facsimile machines, microfilm reader-printer, display device and recording device.

As described in the foregoing, according to the embodiments of the present invention, the fixing film is prevented from being locally heated to such an extent that it is thermally damaged at the times when the fixing operation is started and stopped. Therefore, the durability of the fixing film is improved.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater which is fixed during an image fixing operation;

a film for sliding movement relative to and in contact with said heater and in contact with a recording material;

an urging member for imparting pressure between said heater and said film and between said film and the recording material, wherein a toner image on the recording material is heated by heat from said heater through said film;

detecting means for detecting non-movement of said film; and power supply stopping means for stopping energization of said heater in response to an output of said detecting means.

2. An apparatus according to claim 1, further comprising a roll rotatable together with movement of said film, wherein said detecting means detects stoppage of said film by detecting stoppage of rotation of said roll.

3. An apparatus according to claim 1, wherein said film is provided with a mark, wherein said detecting means detects the mark to detect stoppage of the film.

4. An apparatus according to claim 1, wherein said heater includes a linear heat generating layer extending in a direction crossing a movement direction of said film.

5. An image fixing apparatus, comprising:

a heater which is fixed during an image fixing operation;

a film for sliding movement relative to and in contact with said heater and in contact with a recording material;

an urging member for imparting pressure between said heater and said film and between said film and the recording material, wherein a toner image on the recording material is heated by heat from said heater through said film;

detecting means for detecting a film moving speed; and energization stopping means for stopping energization of said heater when said detecting means detects that the film moving speed detected by said detecting means becomes lower than a predetermined speed.

6. An apparatus according to claim 5, further comprising a roll rotatable together with movement of said film, wherein said detecting means detects the movement speed of said film by detecting a rotational speed of said roll.

7. An apparatus according to claim 5, wherein said film is provided with a mark, wherein said detecting means detects a movement speed of said film

8. An apparatus according to claim 5, wherein said heater includes a linear heat generating layer extending in a direction crossing a movement direction of said film.

9. An image fixing apparatus, comprising:

a heater which is fixed during an image fixing operation;

a film for sliding movement relative to and in contact with said heater and in contact with a recording material;

an urging member for imparting pressure between said heater and said film and between said film and the recording material, wherein a toner image on the recording material is heated by heat from said heater through said film; and wherein drive of said film is stopped after energization of said heater is stopped.

10. An apparatus according to claim 9, wherein said film is stopped after termination of the image fixing operation.

11. An apparatus according to claim 9, wherein said film is stopped when a trouble occurs in conveyance of the recording material.

12. An apparatus according to claim 9, wherein said heater includes a linear heat generating layer extending in a direction crossing a movement direction of said film.

13. An image fixing apparatus, comprising:

a heater which is fixed during an image fixing operation;

a film for sliding movement relative to and in contact with said heater and in contact with a recording material;

an urging member for imparting pressure between said heater and said film and between said film and the recording material, wherein a toner image on the recording material is heated by heat from said heater through said film;

wherein energization of said heater is started after start of driving of said film.

14. An apparatus according to claim 13, wherein said heater includes a linear heat generating layer extending in a direction crossing a movement direction of said film.

15. An apparatus according to claim 13, wherein drive of said film is stopped after energization of said heater is stopped.

* * * * *

UNITED STATES PATENT AND TRADEMARK OFFICE

CERTIFICATE OF CORRECTION

PATENT NO. : 5,043,763

DATED : August 27, 1991

INVENTOR(S) : Shokyo Koh et al.

It is certified that error appears in the above-identified patent and that said Letters Patent is hereby corrected as shown below:

On the title page,

[56] References Cited:

Under "U.S. PATENT DOCUMENTS" heading,

"4,059,394 12/1977 Ariyama et al." should read --4,059,394 11/1977 Ariyama et al.--; and after "4,566,783 1/1986 Schwierz et al." insert --4,699,499 10/1987 Hoshika et al.
4,669,852 6/1987 Tajima et al.--.

IN THE DRAWINGS,

FIGURE 13:

"EMEGENCY" should read --EMERGENCY--.

COLUMN 3:

Line 28, "roller 23" should read --roller 22--;
Line 46, "the" (2nd occurrence) should read --when the--;

COLUMN 4:

Line 8, "member 1," should read --member 21,--;
Line 10, "1" should read --21--;
Line 17, "member" should read --member 21.--;
Line 45, "on" should read --"on"--;
Line 54, "off" should read --"off"--;
Line 56, "shuting" should read --shutting--; and
Line 61, "predetermined," should read --predetermined speed,--.

UNITED STATES PATENT AND TRADEMARK OFFICE

CERTIFICATE OF CORRECTION

PATENT NO. : 5,043,763

DATED : August 27, 1991

INVENTOR(S) : Shokyo Koh et al.

It is certified that error appears in the above-identified patent and that said Letters Patent is hereby corrected as shown below:

COLUMN 5:

Line 4, "mark 62" should read --mark 61--;
Line 5, "means 61" should read --means 62--;
Line 14, "constructed" should read --relates--; and "embodiment, the" should read --embodiment. The--;
Line 34, "100, a" should read --100 and a--; and
Line 37, "housing, the" should read --housing. The--.

COLUMN 6:

Line 26, "drum 3" should read --drum 73--;
Line 55, "member 20" should read --member 80--; and
Line 57, "film 24" should read --film 84--.

COLUMN 7:

Line 16, "member 22." should read --member 822.--; and
Line 67, "being" should be deleted.

COLUMN 8:

Line 43, "film 24" should read --film 84--.

UNITED STATES PATENT AND TRADEMARK OFFICE

CERTIFICATE OF CORRECTION

PATENT NO. : 5,043,763

DATED : August 27, 1991

INVENTOR(S) : Shokyo Koh et al.

It is certified that error appears in the above-identified patent and that said Letters Patent is hereby corrected as shown below:

COLUMN 9:

Line 61, "real," should read --reel,--.

COLUMN 10:

Line 39, "o" should read --or--;
Line 51, "or a" should be changed to --,-- (a comma); and "in" should be deleted; and
Line 55, "film 94" should read --film 84--.

COLUMN 12:

Line 10, "film" should read --film by detecting the mark.--.

Signed and Sealed this

Sixth Day of April, 1993

*Attest:*

*Attesting Officer*

STEPHEN G. KUNIN

*Acting Commissioner of Patents and Trademarks*